US005298195A

United States Patent [19]

Brumbaugh

[11] Patent Number: 5,298,195

[45] Date of Patent: Mar. 29, 1994

[54] LIQUID DISHWASHING DETERGENT

[75] Inventor: Ernest H. Brumbaugh, Rockford, Mich.

[73] Assignee: Amway Corporation, Ada, Mich.

[21] Appl. No.: 848,449

[22] Filed: Mar. 9, 1992

[51] Int. Cl.[5] ..... C11D 1/12; C11D 1/75; C11D 1/83; C11D 3/30

[52] U.S. Cl. ..... 252/547; 252/548; 252/554; 252/DIG. 14

[58] Field of Search ..... 252/547, 544, 174.21, 252/173, DIG. 14, 548, 554

[56] References Cited

U.S. PATENT DOCUMENTS

| | | | |
|---|---|---|---|
| 2,264,103 | 6/1936 | Tucker | 210/23 |
| 3,308,067 | 3/1967 | Diehl | 252/174.23 |
| 3,898,186 | 8/1975 | Mermelstein et al. | 252/528 |
| 3,962,150 | 6/1976 | Viola | 252/547 |
| 3,963,649 | 6/1976 | Spadini et al. | 252/547 |
| 4,003,857 | 1/1977 | Gorsich et al. | 252/547 |
| 4,064,076 | 12/1977 | Klisch et al. | 252/547 |
| 4,070,309 | 1/1978 | Jacobsen | 252/547 |
| 4,077,896 | 3/1978 | Bunegar et al. | 252/544 |
| 4,088,598 | 5/1978 | Williams | 252/174.21 |
| 4,098,713 | 7/1978 | Jones | 252/174.21 |
| 4,102,826 | 7/1978 | Renaud | 252/548 |
| 4,133,779 | 1/1979 | Hellyer et al. | 252/547 |
| 4,133,779 | 1/1979 | Hellyer et al. | 252/547 |
| 4,144,201 | 3/1979 | Winterbotham et al. | 252/547 |
| 4,154,706 | 5/1979 | Kenkare et al. | 252/547 |
| 4,235,752 | 11/1980 | Rossall et al. | 252/551 |
| 4,248,729 | 2/1981 | Rubingh et al. | 252/174.22 |
| 4,263,177 | 4/1981 | Egan et al. | 252/547 |
| 4,276,205 | 6/1981 | Ferry | 252/528 |
| 4,287,102 | 9/1981 | Miyajima et al. | 252/547 |
| 4,305,837 | 12/1981 | Kaminsky et al. | 252/174.12 |
| 4,316,824 | 2/1982 | Pancheri | 252/551 |
| 4,320,033 | 3/1982 | Yoshikawa | 252/547 |
| 4,338,211 | 7/1982 | Stiros | 252/142 |
| 4,371,461 | 2/1983 | Jones et al. | 252/547 |
| 4,371,461 | 2/1983 | Jones et al. | 252/547 |
| 4,394,305 | 7/1983 | Gosselink | 252/528 |
| 4,415,488 | 11/1983 | Blaschke et al. | 252/547 |
| 4,441,881 | 4/1984 | Ruppert et al. | 8/137 |
| 4,457,856 | 7/1984 | Mitchell et al. | 252/166 |
| 4,457,856 | 7/1984 | Mitchell et al. | 252/66 |
| 4,470,923 | 9/1984 | Koster | 252/547 |

(List continued on next page.)

FOREIGN PATENT DOCUMENTS

| | | |
|---|---|---|
| 983806 | 2/1976 | Canada . |
| 1009919 | 5/1977 | Canada . |
| 1109355 | 9/1981 | Canada . |
| 1137260 | 12/1982 | Canada . |

(List continued on next page.)

OTHER PUBLICATIONS

DeForest, Inc, Enterprises, Technical Bulletin Rev. Jul. 1990.

McIntyre Group Ltd., Mackamine TM CAO Bulletin, Jul. 28, 1988.

(List continued on next page.)

*Primary Examiner*—Paul Lieberman
*Assistant Examiner*—Erin Higgins
*Attorney, Agent, or Firm*—Willian Brinks Hofer Gilson & Lione

[57] ABSTRACT

Aqueous liquid dishwashing detergent compositions are prepared that exhibit improved detergency performance and foam stability over a range of water hardness levels. A preferred formulation incorporates a three component mixture: an anionic surfactant, a nonionic surfactant, and an amido amine oxide to provide a detergent having good detergency performance and foam stability over a range of water hardness levels. Another preferred formulation incorporates a three component mixture: an anionic surfactant, a nonionic surfactant, and an alkyl ethoxylated carboxylate to provide a detergent having good detergency performance and foam stability at high hardness levels.

6 Claims, 2 Drawing Sheets

U.S. PATENT DOCUMENTS

| | | | |
|---|---|---|---|
| 4,474,678 | 10/1984 | Lutz et al. | 252/174.21 |
| 4,476,043 | 10/1984 | O'Lenick | 252/544 |
| 4,482,470 | 11/1984 | Reuter et al. | 252/162 |
| 4,490,271 | 12/1984 | Spadini et al. | 252/174.23 |
| 4,492,646 | 1/1985 | Welch | 252/528 |
| 4,508,635 | 4/1985 | Clarke | 252/174.23 |
| 4,548,744 | 10/1985 | Connor | 252/545 |
| 4,554,098 | 11/1985 | Klisch et al. | 252/547 |
| 4,554,099 | 11/1985 | Clarke | 252/551 |
| 4,555,360 | 11/1985 | Bissett et al. | 252/541 |
| 4,595,526 | 6/1986 | Lai | 252/545 |
| 4,612,137 | 9/1986 | Kuroda et al. | 252/174.19 |
| 4,683,008 | 7/1987 | Betts | 134/27 |
| 4,717,507 | 2/1988 | Schwadtke et al. | 252/548 |
| 4,732,704 | 3/1988 | Biermann et al. | 252/548 |
| 4,732,707 | 3/1988 | Naik et al. | 252/548 |
| 4,738,728 | 4/1988 | Barford et al. | 134/34 |
| 4,783,283 | 11/1988 | Stoddart | 252/547 |
| 4,828,757 | 5/1989 | Naylor et al. | 252/544 |
| 4,842,771 | 6/1989 | Rorig et al. | 252/547 |
| 4,853,146 | 8/1989 | Rorig et al. | 252/142 |
| 4,853,147 | 8/1989 | Choi | 252/174.19 |
| 4,857,213 | 8/1989 | Caswell et al. | 252/8.75 |
| 4,863,629 | 9/1989 | Osberghaus et al. | 252/162 |
| 4,877,556 | 10/1989 | Wilsberg et al. | 252/544 |
| 4,891,160 | 1/1990 | Vander Meer | 252/545 |
| 4,904,359 | 2/1990 | Pancheri et al. | 252/548 |
| 4,921,629 | 5/1990 | Malihi et al. | 252/170 |
| 4,923,635 | 5/1990 | Simion et al. | 252/545 |
| 4,923,636 | 5/1990 | Blackburn et al. | 252/550 |
| 4,929,380 | 5/1990 | Schulz et al. | 252/121 |
| 4,946,627 | 8/1990 | Leighton et al. | 252/542 |
| 4,970,028 | 11/1990 | Kenyon et al. | 252/544 |
| 5,000,868 | 3/1991 | Wittpenn, Jr. et al. | 252/106 |
| 5,041,239 | 8/1991 | Rorig et al. | 252/315.1 |
| 5,055,232 | 10/1991 | Sauer et al. | 252/547 |
| 5,180,584 | 1/1993 | Sebag et al. | 252/DIG. 5 |

FOREIGN PATENT DOCUMENTS

| | | |
|---|---|---|
| 1144033 | 4/1983 | Canada . |
| 1154652 | 10/1983 | Canada . |
| 1172403 | 8/1984 | Canada . |
| 1202855 | 4/1986 | Canada . |
| 1203143 | 4/1986 | Canada . |
| 1217109 | 1/1987 | Canada . |
| 1218277 | 2/1987 | Canada . |
| 1236372 | 5/1988 | Canada . |
| 2002095 | 5/1990 | Canada . |
| 2019350 | 12/1990 | Canada . |
| 2025816 | 3/1991 | Canada . |
| 2030990 | 6/1991 | Canada . |
| 2049170 | 2/1992 | Canada . |
| 2027518 | 4/1992 | Canada . |
| 0062371 | 7/1985 | European Pat. Off. . |
| 0264825 | 4/1988 | European Pat. Off. . |
| 0387049 | 9/1990 | European Pat. Off. . |
| 0399752 | 11/1990 | European Pat. Off. . |
| 2336449 | 2/1974 | Fed. Rep. of Germany . |
| 3642564 | 7/1987 | Fed. Rep. of Germany . |
| 242053A1 | 1/1987 | German Democratic Rep. . |
| 57-12100 | 1/1982 | Japan . |
| 58-187499 | 11/1983 | Japan . |
| 62-20597 | 1/1987 | Japan . |
| 62-25197 | 2/1987 | Japan . |

OTHER PUBLICATIONS

DeForest Indus., Inc., DeMox CAPO, Technical Bulletin Rev. Jul. 1990.

Defensive Publication T903,010 published in 903 Official Gazette 1 (Oct. 3, 1972).

LIQUID DISHWASHING DETERGENT

BACKGROUND OF THE INVENTION

This invention relates to light duty dishwashing detergents, and in particular, to light duty dishwashing detergents that are effective over a wide range of water hardness levels. Light duty liquid detergents, such as are suitable for use in the washing of dishes, are well known and have met with a high degree of consumer acceptance because of their good washing and foaming properties and convenient form for use. Most of the formulations in commercial use at the present time are based on synthetic organic detergents which, together with supplementing materials often used, give them satisfactory detergency and foaming properties. Nevertheless, there is an ongoing effort to make products that clean and foam even better and produce more stable foams.

A particular problem with generally available detergents exists when the water used for washing is soft (i.e., has a hardness level less than 25 ppm as $CaCO_3$). At these low water hardness levels, the stability of the foam can be inadequate. Consequently, a need exists for a dishwashing detergent that provides good foam stability over a wide range of water hardness levels.

Surprisingly, it has been found that a dishwashing detergent that is effective and provides stable foam over a wide range of water hardness levels can be prepared by combining, in a three component mixture, an amido amine oxide, an anionic surfactant, and a nonionic surfactant. The use of the amido amine oxide provides an unexpected increase in detergency and foam stability over a range of water hardness levels especially when compared to a detergent formulated with the same anionic and nonionic surfactant without the amido amine oxide. Surprisingly, a detergent containing the amido amine oxide shows a marked increase in performance as the water hardness level is increased when compared to detergents containing an alkyl amine oxide combined with an anionic and nonionic surfactant.

Another problem with generally available detergents exists when the water used for washing has a hardness level greater than about 300 ppm (as $CaCO_3$). At a high hardness level the amount of foam produced and the performance of the detergent is reduced.

Unexpectedly, it has been found that a dishwashing detergent that is effective at high hardness levels can be prepared by combining, in a three component mixture, an alkyl ethoxylated carboxylate, an anionic surfactant, and a nonionic surfactant. A composition containing the alkyl ethoxylated carboxylate shows a surprising increase in detergency when used in hard water (greater than 300 ppm as $CaCO_3$) as compared to the detergency of a composition without the alkyl ethoxylated carboxylate.

The present invention thus provides a detergent that exhibits good detergency performance and foam stability over a range of water hardness levels and a detergent that exhibits good detergency and foam stability at high hardness levels.

SUMMARY OF THE INVENTION

According to one embodiment of the present invention, a detergent that provides good detergency and foam stability over a range of water hardness levels is provided, incorporating into a three component mixture: an anionic surfactant, a nonionic surfactant, and an amido amine oxide. According to a preferred embodiment, the detergent comprises, per 100 parts by weight; 5 to 60 parts by weight of a mixture containing 2.5–95% anionic surfactant, 2.5–95% nonionic surfactant, and 2.5–95% amido amine oxide; 0 to 20 parts by weight of additives; and water comprising the balance. In a particular preferred embodiment, the anionic surfactant is a secondary alkane sulfonate and the nonionic surfactant is a fatty acid alkanolamide.

According to another embodiment of the present invention, a detergent that provides good detergency and foam stability at high water hardness levels is provided, incorporating into a three component mixture: an anionic surfactant, a nonionic surfactant, and an alkyl ethoxylated carboxylate. According to a preferred embodiment, the detergent comprises, per 100 parts by weight; 5 to 60 parts by weight of a mixture containing 5–98% anionic surfactant, 1–94% nonionic surfactant, and 1–20% alkyl ethoxylated carboxylate; 0 to 20 parts by weight of additives; and water comprising the balance. In a particular preferred embodiment, the anionic surfactant is a secondary alkane sulfonate and the nonionic surfactant is a fatty acid alkanolamide.

It is noted that, unless otherwise stated, all percentages given in this specification and the appended claims refer to percentages by weight.

It is also noted that the hardness values, as used in this specification and the appended claims, is intended to refer to hardness expressed as calcium carbonate.

These and other objects, advantages, and features of the present invention will be better understood upon review of the following detailed description of the preferred embodiments.

BRIEF DESCRIPTION OF THE DRAWINGS

Referring to FIG. 1, the area for the combinations useful in carrying out the present invention according to the first embodiment have been labeled. Thus, the areas labeled, A, B, C, and D depict the useful, the preferred, the more preferred and the particularly preferred combinations for carrying out the invention according to the first embodiment, respectively. It will be apparent that they correspond with the ranges (in percent by weight):

| Component | A | B | C | D |
|---|---|---|---|---|
| Anionic Surfactant | 2.5–95 | 20–90 | 40–85 | 50–80 |
| Nonionic Surfactant | 2.5–95 | 5–75 | 5–55 | 10–40 |
| Amido amine oxide | 2.5–95 | 2.5–60 | 5–40 | 5–30 |

Figure 1:
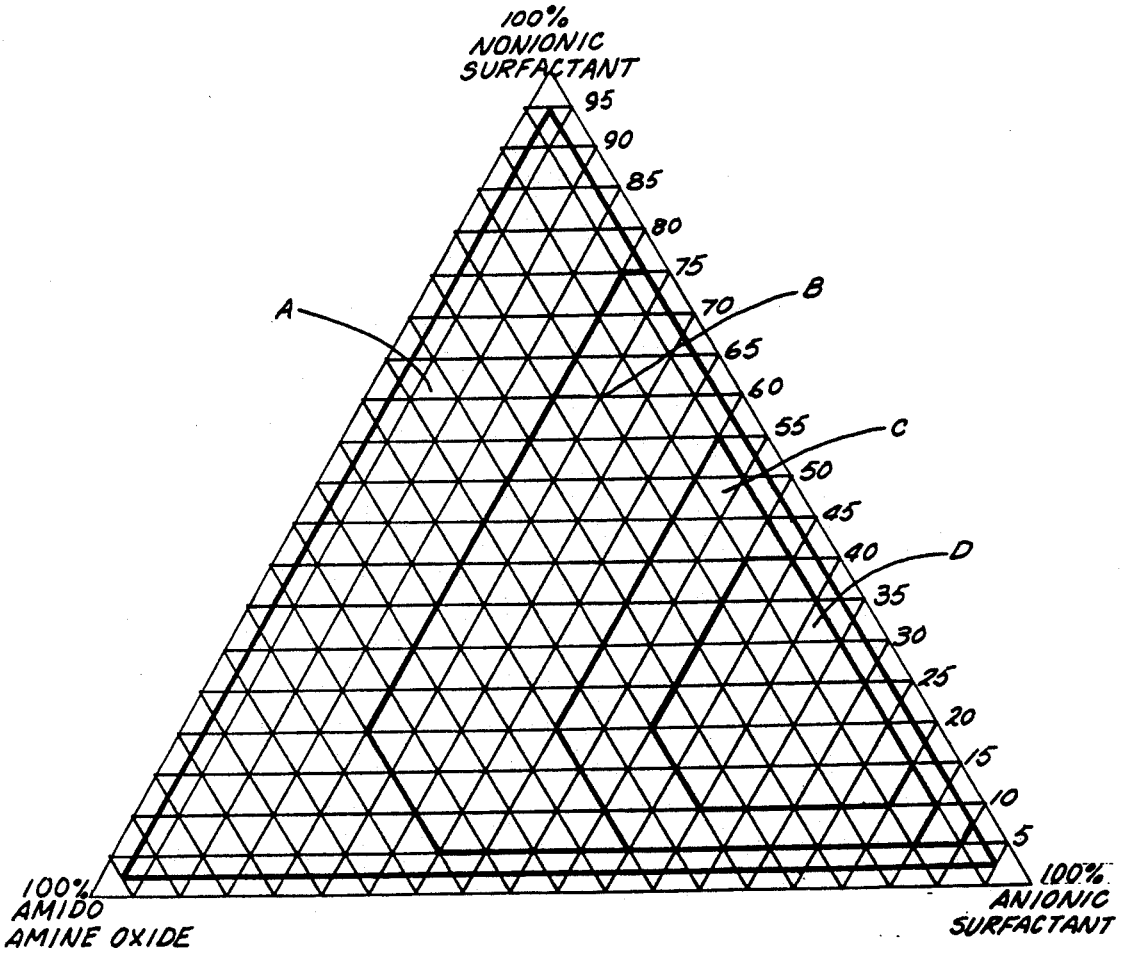
FIG. 1 is a ternary diagram for a first embodiment of the invention where the three component mixture comprises an anionic surfactant, a nonionic surfactant and an amido amine oxide.
Figure 2:
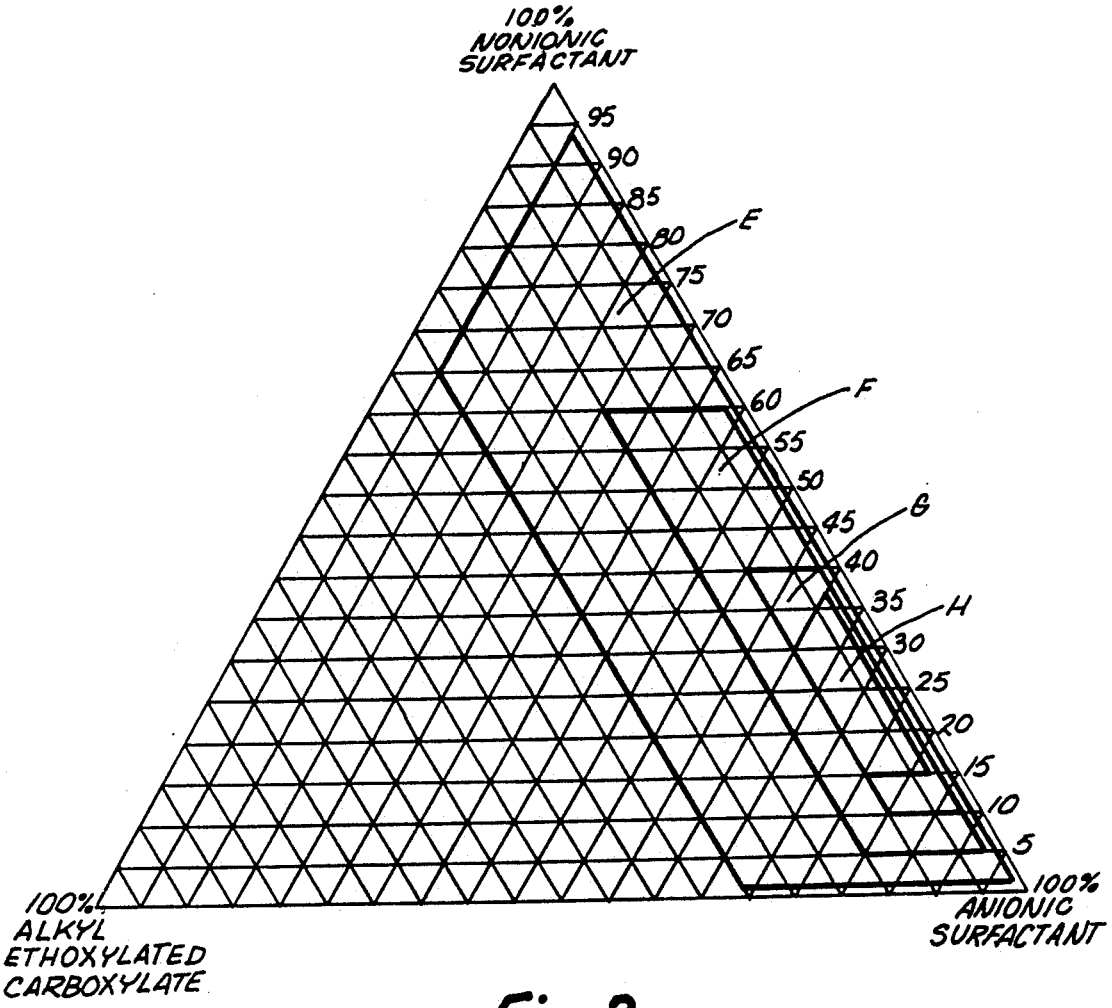
FIG. 2 is a ternary diagram for a second embodiment of the invention where the three component mixture comprises an anionic surfactant, a nonionic surfactant and an alkyl ethoxylated carboxylate.

Referring to FIG. 2, the area for the combinations useful in carrying out the present invention according to the second embodiment have been labeled. Thus, the areas labeled E, F, G, and H depict the useful, the preferred, the more preferred and the particularly preferred combinations for carrying out the invention according to the second embodiment, respectively. It will be apparent that they correspond with the ranges (in percent by weight):

| Component | E | F | G | H |
|---|---|---|---|---|
| Anionic Surfactant | 5-98 | 25-93 | 50-88 | 60-85 |
| Nonionic surfactant | 1-94 | 5-60 | 10-40 | 15-37 |
| Alkyl ethoxylated carboxylate | 1-30 | 2-15 | 2-10 | 3-10 |

DETAILED DESCRIPTION OF THE PREFERRED EMBODIMENTS

In a first embodiment of the invention, the detergent contains, by weight, 5 to 60 parts of a three component mixture that incorporates an anionic surfactant, a nonionic surfactant, and an amido amine oxide; 0 to 20 parts by weight of additives, and water comprising the balance. Preferably, the detergent according to the first embodiment contains, by weight, 10 to 55 parts of the three component mixture. More preferably, the detergent contains, by weight, 20 to 50 parts of the three component mixture.

In a second embodiment of the invention, the detergent contains, by weight, 5 to 60 parts of a three component mixture that incorporates an anionic surfactant, a nonionic surfactant and an alkyl ethoxylated carboxylate; 0 to 20 parts by weight of additives, and water comprising the balance. Preferably, the detergent according to the second embodiment contains, by weight, 10 to 55 parts of the three component mixture. More preferably, the detergent contains, by weight, 20 to 50 parts of the three component mixture.

In both embodiments, the anionic and nonionic surfactants can be, but are not necessarily, the same.

ANIONIC SURFACTANT

Most anionic surfactants can be broadly described as the water-soluble salts, particularly the alkali metal, alkaline earth metal, ammonium and amine salts of organic sulfuric reaction products having in their molecular structure an alkyl radical containing from about 8 to about 22 carbon atoms and a sulfonic acid radical. In particular, the anionic surfactants useful in the present invention are the sodium and magnesium paraffin sulfonates in which the alkyl group contains from about 10 to about 20 carbon atoms.

Alkane or paraffin sulfonates have previously been used as anionic detergent constituents of various detergent compositions. Methods for the manufacture of such sulfonates are known in the art. Typically, all that is usually involved is the reaction of a particular hydrocarbon or hydrocarbon mixture with sulfur dioxide, oxygen and a sulfonation reaction initiator. Normally, it is desirable to produce the sulfonate as the monosulfonate, having no unreacted starting hydrocarbon or having a limited proportion thereof present, and with little or no inorganic salt byproduct. Similarly, the proportions of disulfonate or higher sulfonated material will be minimized but some may be present.

The alkane sulfonates which are a component of the present invention are the water soluble salts of the corresponding sulfonic acids wherein the salt-forming cation a solubilizing metal, an alkaline earth metal such as magnesium, preferably an alkali metal such as sodium or potassium, or ammonium or lower alkanolammonium, such as triethanolammonium, monoethanolammonium, or diisopropanolammonium. The lower alkanol of such alkanolammonium will normally be of 2 to 4 carbon atoms and is preferably ethanol.

There may be present with the monosulfonate a corresponding disulfonate as well as unreacted alkane and by-product sulfate, usually a soluble inorganic sulfate such as sodium, potassium or other cationic sulfate.

In particular, the alkane sulfonates useful in the present invention include those containing from 10 to 20 carbon atoms, particularly from 0 to 16 carbon atoms. Most preferably, they contain from 13 to 17 carbon atoms.

Although the alkyl group can be straight or branched, a straight chain is preferred. In addition, the sulfonate is preferably joined to any secondary carbon atom, i.e., the sulfonate is not terminally joined. In accordance with the most preferred embodiment, the alkane sulfonate is a linear non-terminal secondary $C_{13}$-$C_{17}$ alkyl monosulfonate with a minor portion of disulfonate and sodium sulfate such as can be obtained from Hoechst-Celanese under the trade name Hostapur SAS-30, 60, or 93.

The amount of anionic surfactant present in the three component mixture, according to the first embodiment, ranges from about 2.5% to about 95% preferably from about 20% to about 90%. More preferably, the anionic surfactant is present at about 40% to about 85% with from about 50% to about 80% being particularly preferred.

The amount of anionic surfactant present in the three component mixture, according to the second embodiment, ranges from about 5% to about 98% preferably from about 25% to about 93%. More preferably, the anionic surfactant is present at about 50% to about 88% with from about 60% to about 85% being particularly preferred.

NONIONIC SURFACTANT

The nonionic surfactant operable in the present invention is an amide. In particular, the amide type of nonionic surfactant includes the ammonia, monoalkanol, and dialkanol amides of fatty acids having an acyl moiety of from about 8 to about 18 carbon atoms where the alkanol has from 2 to 4 carbon atoms and is represented by the general formula:

$$R_1—CO—N(H)_{m-1}(R_2OH)_{3-m}$$

wherein $R_1$ is a saturated or unsaturated aliphatic hydrocarbon radical having from 8 to 18, preferably from 12 to 14 carbon atoms; $R_2$ is a methylene, ethylene, or propylene group; and m is 1, 2, or 3, preferably 1 or 2, most preferably 1.

Examples of amides that are useful in the present invention, include but are not limited to, the mono and diethanol coconut, lauric, and myristic fatty acid amides. The acyl moieties may be derived from naturally occurring glycerides, e.g., coconut oil, palm oil, soybean oil and tallow, but can be derived synthetically, e.g., by the oxidation of petroleum, or hydrogenation of carbon monoxide by the Fischer-Tropsch process.

The monoethanolamides and diethanolamides of $C_{12}$-$C_{14}$ fatty acids are preferred. The diethanolamide of coconut fatty acid such as Ninol 40-C0 from Stepan Chemical Co. is particularly preferred.

The amount of nonionic surfactant present in the three component mixture, according to the first embodiment, ranges from about 2.5% to about 95% preferably from about 5% to about 75%. More preferably, the nonionic surfactant is present at about 5% to about 55% with from about 10% to about 40% being particularly preferred.

The amount of nonionic surfactant present in the three component mixture, according to the second embodiment, ranges from about 1% to about 94% preferably from about 5% to about 60%. More preferably, the anionic surfactant is present at about 10% to about 40% with from about 15% to about 37% being particularly preferred.

AMIDO AMINE OXIDE

As described above, the three component mixture according to the first embodiment contains an anionic surfactant, a nonionic surfactant, and an amido amine oxide. In particular, the amido amine oxide comprises compounds and mixtures of compounds having the formula:

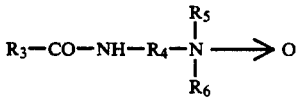

wherein $R^3$ is a $C_{8-18}$ alkyl, $R^4$ is a $C_{2-4}$ alkyl, and $R^5$ and $R^6$ are a $C_{1-5}$ alkyl or hydroxy alkyl. Preferably, $R^3$ is a $C_{12-14}$ alkyl, $R^4$ is ethyl or propyl, and $R^5$ and $R^6$ are methyl or ethyl.

Examples of amido amine oxides which may be useful in the present invention include, but are not necessarily limited to, babassuamidopropyl amine oxide, cocamidopropyl amine oxide, isostearylamidopropyl amine oxide, isostearylamidopropyl morpholine oxide, lauramidopropyl amine oxide, minkamidopropyl amine oxide, oleoamidopropyl amine oxide, olivamidopropyl amine oxide, sesamidopropyl amine oxide, stearamidopropyl amine oxide, and wheat germ amidopropyl amine oxide. A particularly preferred amido amine oxide is Varox 1770 from, Sherex, wherein $R^3$ is a $C_{12}$ alkyl, $R^4$ is propyl, and $R^5$, $R^6$ are methyl.

The amount of the amido amine oxide present in the three component mixture ranges from about 2.5% to about 95% preferably from about 2.5% to about 60%. More preferably, the amido amine oxide is present at about 5% to about 40% with from about 5% to about 30% being particularly preferred.

ALKYL ETHOXYLATED CARBOXYLATE

As described above, the three component mixture according to the second embodiment contains an anionic surfactant, a nonionic surfactant, and an alkyl ethoxylated carboxylate. In particular, the alkyl ethoxylated carboxylate comprises compounds and mixtures of compounds having the formula:

$$R^7(OC_2H_4)_n—OCH_2COO^- M^+$$

wherein $R^7$ is a $C_{4-18}$ alkyl, n is from about 3 to about 20, and M is hydrogen, a solubilizing metal, preferably an alkali metal such as sodium or potassium, or ammonium or lower alkanolammonium, such as triethanolammonium, monoethanolammonium, or diisopropanolammonium. The lower alkanol of such alkanolammonium will normally be of 2 to 4 carbon atoms and is preferably ethanol. Preferably, $R^7$ is a $C_{12-15}$ alkyl, n is from about 7 to about 13, and M is an alkali metal.

Examples of alkyl ethoxylated carboxylates that may be useful in the present invention include, but are not necessarily limited to, sodium buteth-3 carboxylate, sodium hexeth-4 carboxylate, sodium laureth-5 carboxylate, sodium laureth-6 carboxylate, sodium laureth-8 carboxylate, sodium laureth-11 carboxylate, sodium laureth-13 carboxylate, sodium trideceth-3 carboxylate, sodium trideceth-6 carboxylate, sodium trideceth-7 carboxylate, sodium trideceth-19 carboxylate, sodium capryleth-4 carboxylate, sodium capryleth-6 carboxylate, sodium capryleth-9 carboxylate, sodium capryleth-13 carboxylate, sodium ceteth-13 carboxylate, sodium $C_{12-15}$ pareth-6 carboxylate, sodium $C_{12-15}$ pareth-7 carboxylate, sodium $C_{14-15}$ pareth-8 carboxylate, isosteareth-6 carboxylate as well as the acid form. Sodium laureth-8 carboxylate, sodium laureth-13 carboxylate, pareth-25-7 carboxylic acid are preferred. A particularly preferred sodium laureth-13 carboxylate can be obtained from Finetex under the trade name Surfine WLL and from Sandoz under the trade name Sandopan LS-24.

The amount of alkyl ethoxylated carboxylate present in the three component mixture ranges from about 1% to about 30% preferably from about 2% to about 15%. More preferably, the alkyl ethoxylated carboxylate is present at about 2% to about 10% with from about 3% to about 10% being particularly preferred.

WATER

Water comprises the balance of the detergent composition. Accordingly, the compositions of both the first and second embodiment can contain, per 100 parts of the detergent composition, from about 40 to about 95 parts of water.

OPTIONAL INGREDIENTS

Since the detergent compositions of the present invention are in liquid form, stabilizing agents can be included to achieve the desired phase stability, viscosity, pH balance and other desired composition characteristics. For example, short chain water soluble alcohols or glycols, preferably having from 2 to 6 carbon atoms can be added. Up to about 10% of propylene glycol, butylene glycol, hexylene glycol and mixtures thereof, are preferred.

Commonly used hydrotropes can include conventional lower alkylaryl sulfonates such as sodium and potassium, toluene sulfonate, xylene sulfonate, benzene sulfonate, and cumene sulfonate. Sodium and potassium toluene sulfonate, sodium and potassium xylene sulfonate and related compounds and can be used to achieve the desired product phase stability, viscosity and yield value. Sodium xylene sulfonate up to a level of about 5% is useful.

Alkalinity sources, pH buffering agents, and pH control agents such as alkali metal carbonates and bicarbonates, monoethanolamine, triethanolamine, tris hydroxy methylamine, and alkali metal hydroxides can also be used. The mono, di, and triethanolamines are preferred and can be added up to a level of about 5%.

Builders may also be added, although they have limited value in dishwashing compositions. Either inorganic or organic builders may be used alone or in combination with themselves. Examples of such builders are alkali metal carbonates, phosphates, polyphosphates, and silicates.

Sequestrants can also be incorporated into the compositions. Examples are the alkali metal polycarboxylates, such as sodium and potassium citrate, sodium and potassium tartrate, citric acid, sodium and potassium ethylenediaminetetraacetate (EDTA), triacetates, sodium and potassium nitrilotriacetates (NTA), and mixtures thereof. Up to about 10% of citric acid can be used.

In addition, the detergent compositions of the present invention can contain, if desired, other optional ingredients including any of the usual adjuvants, diluents, and additives such as perfumes, enzymes, dyes, anti-tarnishing agents, antimicrobial agents, abrasives, hand softening agents such as aloe vera gel, water soluble salts of alkaline earth metals such as magnesium sulfate, and the like without detracting from the advantageous properties of the compositions.

The compositions can contain up to about 20% of these optional ingredients.

The following examples are given to illustrate the compositions of the invention. In the examples the abbreviations used have the following meanings.

| Abbreviation | Description |
|---|---|
| SAS | Secondary $C_{13-17}$ alkane sulfonate |
| CDEA | Coconut diethanolamide |
| AAO | Cocamidopropyl amine oxide |
| $AO^1$ | Coco amine oxide |
| $AO^2$ | Lauryl amine oxide |
| Pareth-25-7 | Pareth-25-7 carboxylic acid |
| Laureth-8 | Laureth-8 carboxylic acid |
| Na Laureth-13 | Sodium Laureth-13 carboxylate |
| Glycol | Propylene glycol |
| SXS | Sodium xylene sulfonate |

EXAMPLE 1

The following liquid detergent compositions were prepared.

| | A | B | C | D |
|---|---|---|---|---|
| SAS | 31.5 | 31.5 | 31.5 | 31.5 |
| CDEA | 13.5 | 9.0 | 9.9 | 9.0 |
| AAO | — | 4.5 | — | — |
| $AO^1$ | — | — | 4.5 | — |
| $AO^2$ | — | — | — | 4.5 |
| Glycol | 5.0 | 5.0 | 5.0 | 5.0 |
| SXS | 2.0 | 2.0 | 2.0 | 2.0 |
| Additional optional ingredients | ~1 | ~1 | ~1 | ~1 |
| Water | | remainder | | |

Composition B is within the scope of the present invention. Compositions A, C, and D may be representative of presently used dishwashing detergent compositions and are outside the scope of the present invention.

The "miniplate dishwashing test" was used to evaluate the performance of the compositions. In the "miniplate" test, small plates having a standard amount of a standard grease coating applied thereto are washed in warm water, e.g., at 120° F. at the beginning of the test, at different hardnesses and with different concentrations of liquid detergent and the number of plates washed until the foam disappears are counted.

Each of the compositions in Example 1 were evaluated at varying water hardness levels using the "miniplate" test where the compositions were used at a level of 0.075%. The following results were observed:

TABLE 1

| | Dishwashing Performance (No. of Plates) WATER HARDNESS (ppm) | | | | |
|---|---|---|---|---|---|
| COMPOSITION | 0 | 15 | 150 | 300 | 450 |
| A | 6.5 | 9.0 | 10.0 | 8.5 | 6.0 |
| B | 8.1 | 9.7 | 11.2 | 10.5 | 9.5 |
| C | 9.0 | — | 7.25 | — | — |
| D | 6.0 | 8.5 | 7.5 | — | — |

EXAMPLE 2

The following liquid detergent compositions were prepared.

| | E | F | G | H | I |
|---|---|---|---|---|---|
| SAS | 31.5 | 30.1 | 28.7 | 30.1 | 30.1 |
| CDEA | 13.5 | 12.9 | 12.3 | 12.9 | 12.9 |
| Pareth-25-7 | — | 2.0 | 4.0 | — | — |
| Laureth-8 | — | — | — | 2.0 | — |
| Na Laureth-13 | — | — | — | — | 2.0 |
| Glycol | 5.0 | 5.0 | 5.0 | 5.0 | 5.0 |
| SXS | 2.0 | 2.0 | 2.0 | 2.0 | 2.0 |
| Additional optional ingredients | ~1 | ~1 | ~1 | ~1 | ~1 |
| Water | | | remainder | | |

Compositions F, G, H, and I are within the scope of the present invention. Composition E may be representative of presently used dishwashing detergent compositions and is outside the scope of the present invention.

Each of the compositions in Example 2 were evaluated at varying water hardness levels using the "miniplate" test where the compositions were used at a level of 0.075%. The following results were observed.

TABLE 2

| | Dishwashing Performance (No. of Plates) WATER HARDNESS (ppm) | | | | | | |
|---|---|---|---|---|---|---|---|
| COMPOSITION | 0 | 5 | 15 | 50 | 150 | 300 | 450 |
| E | 5.5 | 7.5 | 8.75 | 10.0 | 9.6 | 8.0 | 6.125 |
| F | 5.5 | — | 8.0 | 9.5 | 9.5 | 9.5 | 9.0 |
| G | 5.5 | 7.0 | 9.5 | 9.0 | 10.0 | 10.0 | 9.0 |
| H | 4.0 | — | — | 10.0 | 9.5 | 9.25 | 8.0 |
| I | 5.75 | — | 8.0 | 10.0 | 10.5 | 9.75 | 9.0 |

EXAMPLE 3

The following liquid detergent compositions were prepared where composition J is the most preferred embodiment of a liquid detergent composition according to the first embodiment of the invention and composition K is the most preferred embodiment of a liquid detergent according to the second embodiment of the invention.

| | J | K |
|---|---|---|
| SAS | 31.5 | 30.1 |
| CDEA | 9.0 | 12.9 |
| AAO | 4.5 | — |
| Na Laureth-13 | — | 1.9 |
| Glycol | 5.0 | 2.5 |
| SXS | 0.4 | 2.0 |
| Additional optional ingredients | 0.66 | 1.06 |
| Water | remainder | |

The key to obtaining the desired detergency and foam stability appears to depend on the proper selection and relative amounts of the ingredients in the three component mixtures.

Of course, it should be understood that a wide range of changes and modifications can be made to the embodiments described above. It is therefore intended that the foregoing description illustrates rather than limits this invention, and that it is the following claims, including all equivalents, which define this invention.

I claim:

1. A liquid dishwashing detergent composition consisting essentially of per 100 parts by weight:

(a) 5 to 60 parts by weight of a three component mixture containing 2.5–95% anionic surfactant, 2.5–95% nonionic surfactant, and 2.5–95% amido amine oxide;

(b) 0 to 20 parts of additives; and (c) water comprising the balance, wherein the anionic surfactant is selected from the group consisting of $C_8$–$C_{20}$ secondary alkane sulfonates and mixtures thereof; the nonionic surfactant is an amide selected from the group consisting of amides of the formula $$R_1\text{—CO—N(H)}_{m-1}(R_2OH)_{3-m}$$

wherein $R_1$ is a saturated or unsaturated aliphatic hydrocarbon radial having from 8 to 18 carbon atoms; $R_2$ is a methylene, ethylene, or propylene group; and m is 1, 2 or 3, and mixtures thereof; and the amido amine oxide is selected from the group consisting of the formula

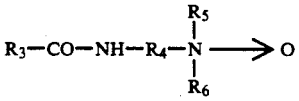

wherein $R_3$ is a $C_{8-18}$ alkyl, $R_4$ is a $C_{2-4}$ alkyl, and $R_5$ and $R_6$ are a $C_{1-5}$ alkyl or hydroxy alkyl, and mixtures thereof.

2. The composition of claim 1 wherein the anionic surfactant is a $C_{13}$–$C_{17}$ secondary alkane sulfonate.

3. The composition of claim 1 wherein the nonionic surfactant is an amide selected from the group consisting of amides of the formula $$R_1\text{—CO—N(H)}_{m-1}(R_2OH)_{3-m}$$

wherein $R_1$ is a saturated aliphatic hydrocarbon radical having from 12 to 14 carbon atoms; $R_2$ is an ethylene group; and m is 1 or 2, and mixtures thereof.

4. The composition of claim 3 wherein the amide is coconut diethanolamide.

5. The composition of claim 1 wherein the amido amine oxide is selected from the group consisting of the formula

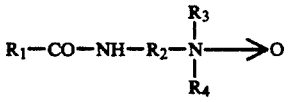

wherein $R_1$ is a $C_{12-14}$ alkyl, $R_2$ is a $C_3$ alkyl, and $R_3$ and $R_4$ are a $C_1$ alkyl or hydroxy alkyl, and mixtures thereof.

6. A liquid dishwashing detergent composition consisting essentially of, per 100 parts by weight:

a. 5 to 60 parts by weight of a three component mixture containing 2.5–95% anionic surfactant, 2.5–95% nonionic surfactant, and 2.5–95% amido amine oxide;

b. 0 to 20 parts of additives; and, c. water comprising the balance, wherein the anionic surfactant is a $C_{13}$–$C_{17}$ secondary alkane sulfonate, the nonionic surfactant is an amide selected from the group consisting of amides of the formula $$R_1\text{—CO—N(H)}_{m-1}(R_2OH)_{3-m}$$

wherein $R_1$ is a saturated aliphatic hydrocarbon radical having from 12 to 14 carbon atoms; $R_2$ is an ethylene group; and m is 1 or 2, and mixtures thereof, and the amido amine oxide is selected from the group consisting of the formula

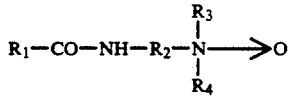

wherein $R_1$ is a $C_{12-14}$ alkyl, $R_2$ is a $C_3$ alkyl, and $R_3$ and $R_4$ are a $C_1$ alkyl or hydroxy alkyl, and mixtures thereof.

* * * * *

UNITED STATES PATENT AND TRADEMARK OFFICE

CERTIFICATE OF CORRECTION

PATENT NO. : 5,298,195 Page 1 of 2

DATED : March 29, 1994

INVENTOR(S) : Ernest H. Brumbaugh

It is certified that error appears in the above-indentified patent and that said Letters Patent is hereby corrected as shown below:

On title page, item [56], "OTHER PUBLICATIONS" col. 2, line 1, delete "Inc," and substitute —Inc.—

In column 4, line 12, delete "0" and substitute --10--.

In column 5, line 29, delete "$R^3$" and substitute --$R_3$--.

In column 5, line 29, delete "$R^4$" and substitute --$R_4$--.

In column 5, line 29, delete "$R^5$" and substitute --$R_5$--.

In column 5, line 30, delete "$R^6$" and substitute --$R_6$--.

In column 5, line 30, delete "$R^3$" and substitute --$R_3$--.

In column 5, line 31, delete "$R^4$" and substitute --$R_4$--.

In column 5, line 31, delete "$R^5$" and substitute --$R_5$--.

In column 5, line 31, delete "$R^6$" and substitute --$R_6$--.

In column 5, line 43, delete "$R^3$" and substitute --$R_3$--.

In column 5, line 44, delete "$R^4$" and substitute --$R_4$--.

In column 5, line 44, delete "$R^5$" and substitute --$R_5$--.

In column 5, line 44, delete "$R^6$" and substitute --$R_6$--.

In column 5, line 60, delete "$R^7$" and substitute --$R_7$--.

In column 5, line 62, delete "$R^7$" and substitute --$R_7$--.

UNITED STATES PATENT AND TRADEMARK OFFICE

CERTIFICATE OF CORRECTION

PATENT NO. : 5,298,195

DATED : March 29, 1994

INVENTOR(S) : Ernest H. Brumbaugh

It is certified that error appears in the above-indentified patent and that said Letters Patent is hereby corrected as shown below:

In column 6, line 1, delete "$R^7$" and substitute --$R_7$--.

IN THE CLAIMS

Col. 9, claim 1, line 16, delete "radial" and substitute --radical--.

Signed and Sealed this

Thirty-first Day of January, 1995

*Attest:*

*Attesting Officer*

Bruce Lehman

BRUCE LEHMAN

*Commissioner of Patents and Trademarks*